US005911874A

United States Patent [19]

Cody et al.

[11] Patent Number: 5,911,874

[45] **Date of Patent: *Jun. 15, 1999**

[54] RAFFINATE HYDROCONVERSION PROCESS

[75] Inventors: Ian A. Cody; Douglas R. Boate, both of Baton Rouge, La.

[73] Assignee: Exxon Research and Engineering Co., Florham Park, N.J.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/768,251

[22] Filed: Dec. 17, 1996

Related U.S. Application Data

[63] Continuation-in-part of application No. 08/678,382, Jun. 28, 1996.

[51] Int. Cl.[6] ..... C10G 1/04

[52] U.S. Cl. ..... 208/87; 208/18; 208/27; 208/28; 208/31; 208/58; 208/96; 208/97

[58] Field of Search ..... 208/58, 87, 18, 208/27, 28, 31, 96, 97

[56] References Cited

U.S. PATENT DOCUMENTS

| | | | |
|---|---|---|---|
| 3,779,896 | 12/1973 | Woodle | 208/86 |
| 4,181,598 | 1/1980 | Gillespie | 208/58 |
| 4,229,282 | 10/1980 | Peters et al. | 208/87 |
| 4,383,913 | 5/1983 | Powell et al. | 208/59 |
| 4,636,299 | 1/1987 | Unmuth | 208/87 |
| 5,013,422 | 5/1991 | Absil et al. | 208/27 |
| 5,273,645 | 12/1993 | Clark et al. | 208/87 |
| 5,300,213 | 4/1994 | Bartilucci et al. | 208/87 |

*Primary Examiner*—Helane Myers
*Attorney, Agent, or Firm*—J. H. Takemoto

[57] ABSTRACT

A process for upgrading a wax-containing feedstock to produce a wax and a high VI/low volatility lubricating oil basestock. The process comprises subjecting the raffinate from a solvent extraction step to a two step, single stage hydroconversion process wherein the first step involves severe hydroconversion of the raffinate followed by a cold hydrofinishing step.

19 Claims, 3 Drawing Sheets

RAFFINATE HYDROCONVERSION PROCESS

This application is a continuation-in-part of U.S. Ser. No. 08/678,382 filed Jun. 28, 1996.

FIELD OF THE INVENTION

This invention relates to a process for preparing lubricating oil basestocks having high viscosity indices and low volatilities and for recovering petroleum wax from wax-containing feedstocks.

BACKGROUND OF THE INVENTION

It is well known to produce lubricating oil basestocks by solvent refining. In the conventional process, crude oils are fractionated under atmospheric pressure to produce atmospheric resids which are further fractionated under vacuum. Select distillate fractions are then optionally deasphalted and solvent extracted to produce a paraffin rich raffinate and an aromatics rich extract. The raffinate is then dewaxed to produce a dewaxed oil which is usually hydrofinished to improve stability and remove color bodies.

Solvent refining is a process which selectively isolates components of crude oils having desirable properties for lubricant basestocks. Thus the crude oils used for solvent refining are restricted to those which are highly paraffinic in nature as aromatics tend to have lower viscosity indices (VI), and are therefore less desirable in lubricating oil basestocks. Also, certain types of aromatic compounds can result in unfavorable toxicity characteristics. Solvent refining can produce lubricating oil basestocks have a VI of about 95 in good yields.

Today more severe operating conditions for automobile engines have resulted in demands for basestocks with lower volatilities (while retaining low viscosities) and lower pour points. These improvements can only be achieved with basestocks of more isoparaffic character, i.e., those with VI's of 105 or greater. Solvent refining alone cannot economically produce basestocks having a VI of 105 with typical crudes. Two alternative approaches have been developed to produce high quality lubricating oil basestocks; (1) wax isomerization and (2) hydrocracking. Both of the methods involve high capital investments. In some locations wax isomerization economics can be adversely impacted when the raw stock, slack wax, is highly valued. Moreover, hydrocracking eliminates some of the solvency properties of basestocks produced by traditional solvent refining techniques. Also, the typically low quality feedstocks used in hydrocracking, and the consequent severe conditions required to achieve the desired viscometric and volatility properties can result in the formation of undesirable (toxic) species. These species are formed in sufficient concentration that a further processing step such as extraction is needed to achieve a non-toxic base stock.

An article by S. Bull and A. Marmin entitled "Lube Oil Manufacture by Severe Hydrotreatment", Proceedings of the Tenth World Petroleum Congress, Volume 4, Developments in Lubrication, PD 19(2), pages 221–228, describes a process wherein the extraction unit in solvent refining is replaced by a hydrotreater.

U.S. Pat. No. 3,691,067 describes a process for producing a medium and high VI oil by hydrotreating a narrow cut lube feedstock. The hydrotreating step involves a single hydrotreating zone. U.S. Pat. No. 3,732,154 discloses hydrofinishing the extract or raffinate from a solvent extraction process. The feed to the hydrofinishing step is derived from a highly aromatic source such as a naphthenic distillate. U.S. Pat. No. 4,627,908 relates to a process for improving the bulk oxidation stability and storage stability of lube oil basestocks derived from hydrocracked bright stock. The process involves hydrodenitrification of a hydrocracked bright stock followed by hydrofinishing.

It would be desirable to supplement the conventional solvent refining process so as to produce high VI, low volatility oils which have excellent toxicity, oxidative and thermal stability, solvency, fuel economy and cold start properties without incurring any significant yield debit which process requires much lower investment costs than competing technologies such as hydrocracking, and to recover wax from the process as a valuable co-product.

SUMMARY OF THE INVENTION

This invention relates to a process for upgrading a wax-containing feedstock to produce a lubricating oil basestock and a petroleum wax by selectively hydroconverting a raffinate produced from solvent refining a lubricating oil feedstock which comprises:

(a) conducting the lubricating oil feedstock and the wax-containing feedstock to a solvent extraction zone and separating therefrom an aromatics rich extract and a paraffins rich raffinate;

(b) stripping the raffinate of solvent to produce a raffinate feed having a dewaxed oil viscosity index from about 85 to about 105 and a final boiling point of no greater than about 650° C.;

(c) passing the raffinate feed to a first hydroconversion zone and processing the raffinate feed in the presence of a non-acidic catalyst at a temperature of from 340 to 420° C., a hydrogen partial pressure of from 600 to 2000 psig, space velocity of 0.2 to 3.0 LHSV and a hydrogen to feed ratio of from 500 to 5000 Scf/B to produce a first hydroconverted raffinate;

(d) passing the first hydroconverted raffinate to a second reaction zone and conducting cold hydrofinishing of the first hydroconverted raffinate in the presence of a hydrofinishing catalyst at a temperature of from 200 to 320° C., a hydrogen partial pressure of from 600 to 2000 psig, a space velocity of from 1 to 5 LHSV and hydrogen to feed ratio of from 500 to 5000 Scf/B to produce a second hydroconverted raffinate;

(e) passing the second hydroconverted raffinate to a separation zone to remove products having a boiling less than about 250° C.; and (f) passing the second hydroconverted raffinate to a dewaxing zone to produce a wax and a dewaxed basestock having a viscosity index of at least 105 provided that the basestock has a dewaxed oil viscosity index increase of at least 10 greater than the raffinate feed, a NOACK volatility improvement over raffinate feedstock of at least about 3 wt. % at the same viscosity in the range of viscosity from 3.5 to 6.5 cSt viscosity at 100° C., and a residual aromatics content of at least about 5 vol. % provided that the basestock has low toxicity and passes the IP346 or FDA(c) tests notwithstanding the residual aromatics content, and (g) isolating the wax from step (f) as a co-product.

In another embodiment, this invention relates to a process for upgrading a wax-containing feedstock to produce a lubricating oil basestock and a petroleum wax by selectively hydroconverting a raffinate produced from solvent refining a lubricating oil feedstock which comprises:

(a) conducting the lubricating oil feedstock to a solvent extraction zone and separating therefrom an aromatics rich extract and a paraffins rich raffinate;

(b) stripping the raffinate of solvent to produce a raffinate feed having a dewaxed oil viscosity index from about 85 to about 105 and a final boiling point of no greater than about 650° C.;

(c) combining the raffinate feed with the wax-containing feedstock to produce a combined raffinate feed, (d) passing the combined raffinate feed to a first hydroconversion zone and processing the combined raffinate feed in the presence of a non-acidic catalyst at a temperature of from 340 to 420° C., a hydrogen partial pressure of from 600 to 2000 psig, space velocity of 0.2 to 3.0 LHSV and a hydrogen to feed ratio of from 500 to 5000 Scf/B to produce a first hydroconverted raffinate; and (e) passing the first hydroconverted raffinate to a second reaction zone and conducting cold hydrofinishing of the first hydroconverted raffinate in the presence of a hydrofinishing catalyst at a temperature of from 200 to 320° C., a hydrogen partial pressure of from 600 to 2000 psig, a space velocity of from 1 to 5 LHSV and hydrogen to feed ratio of from 500 to 5000 Scf/B to produce a second hydroconverted raffinate, (f) passing the second hydroconverted raffinate to a separation zone to remove products having a boiling less than about 250° C.; and (g) passing the second hydroconverted raffinate to a dewaxing zone to produce a wax and a dewaxed basestock having a viscosity index of at least 105 provided that the basestock has a dewaxed oil viscosity index increase of at least 10 greater than the raffinate feed, a NOACK volatility improvement over raffinate feedstock of at least about 3 wt. % at the same viscosity in the range of viscosity from 3.5 to 6.5 cSt viscosity at 100° C., and a residual aromatics content of at least about 5 vol. % provided that the basestock has low toxicity and passes the IP346 or FDA(c) tests notwithstanding the residual aromatics content, and (h) isolating the wax from step (g) as a co-product.

The process according to the invention produces in good yields a basestock which has VI and volatility properties meeting future industry engine oil standards while achieving good solvency, cold start, fuel economy, oxidation stability and thermal stability properties. In addition, toxicity tests show that the basestock has excellent toxicological properties as measured by tests such as the FDA(c) test. The process also produces a valuable wax product from low value refinery streams containing wax and upgrading such streams to more valuable products.

DETAILED DESCRIPTION OF THE INVENTION

Figure 1:
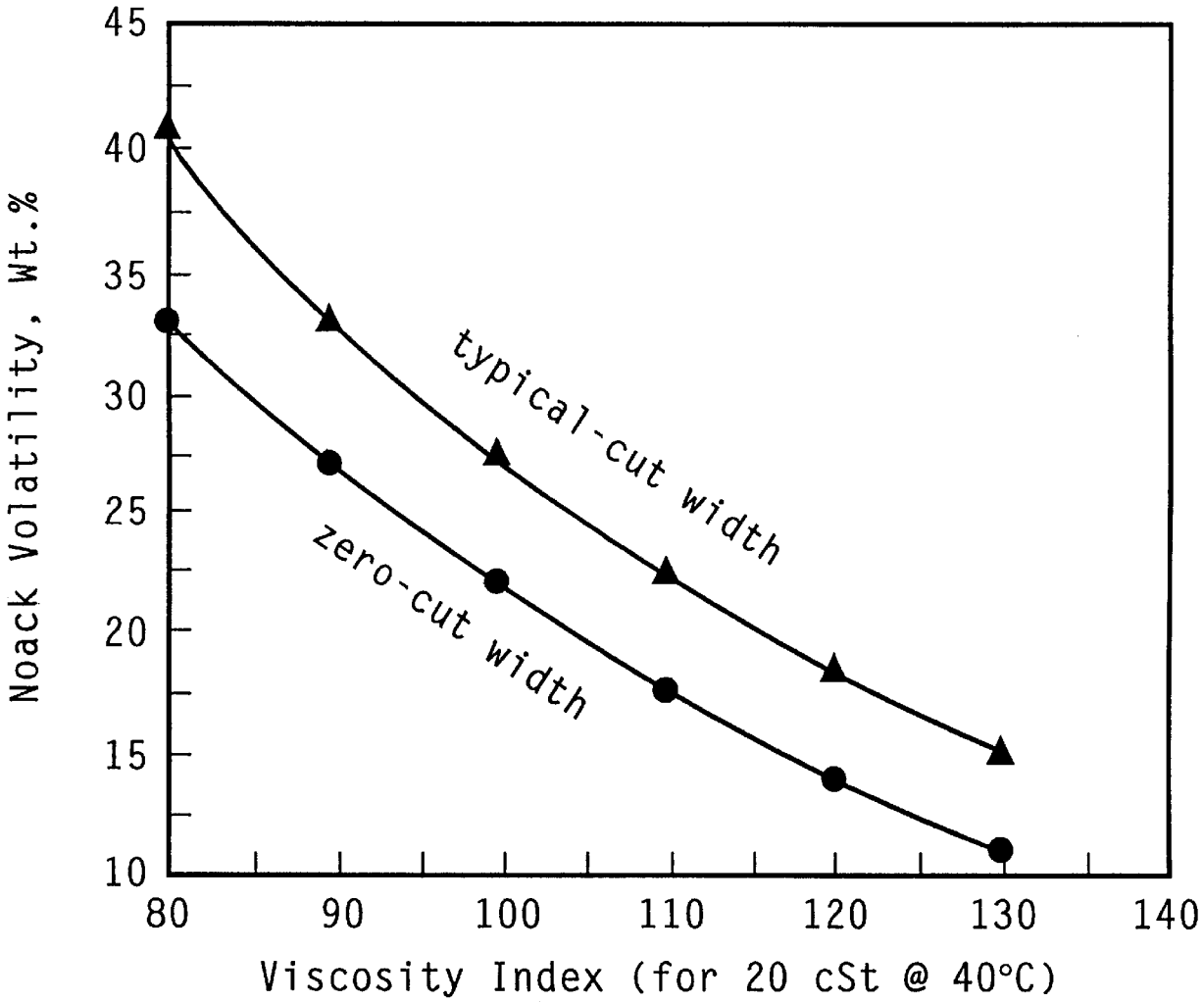
FIG. 1 is a plot of NOACK volatility vs. viscosity index for a 100N basestock.

The solvent refining of select crude oils to produce lubricating oil basestocks typically involves atmospheric distillation, vacuum distillation, extraction, dewaxing and hydrofinishing. Because basestocks having a high isoparaffin content are characterized by having good viscosity index (VI) properties and suitable low temperature properties, the crude oils used in the solvent refining process are typically paraffinic crudes.

Generally, the high boiling petroleum fractions from atmospheric distillation are sent to a vacuum distillation unit, and the distillation fractions from this unit are solvent extracted. The residue from vacuum distillation which may be deasphalted is sent to other processing. Other wax-containing streams may also be added as feedstock. An example of such streams is foots oil which is oil and low melting materials removed from slack wax to produce a finished wax. It is preferred that the wax-containing stream be pre-extracted and contain at least about 20 wt. % wax, preferably at least about 50 wt. % wax. These streams are typically of low value and using them as feedstock to the present process permits upgrading of the streams by isolating the wax as valuable co-product while converting the non-waxy paraffin content to lubricating oil basestock. The wax-containing stream may be added to the distillation fractions described above prior to solvent extraction or may be added to the raffinate isolated from the solvent extraction step prior to the first hydroconversion zone.

The solvent extraction process selectively dissolves the aromatic components in an extract phase while leaving the more paraffinic components in a raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases.

In recent years, solvent extraction has been replaced by hydrocracking as a means for producing high VI basestocks in some refineries. The hydrocracking process utilizes low quality feeds such as feed distillate from the vacuum distillation unit or other refinery streams such as vacuum gas oils and coker gas oils. The catalysts used in hydrocracking are typically sulfides of Ni, Mo, Co and W on an acidic support such as silica/alumina or alumina containing an acidic promoter such as fluorine. Some hydrocracking catalysts also contain highly acidic zeolites. The hydrocracking process may involve hetero-atom removal, aromatic ring saturation, dealkylation of aromatics rings, ring opening, straight chain and side-chain cracking, and wax isomerization depending on operating conditions. In view of these reactions, separation of the aromatics rich phase that occurs in solvent extraction is an unnecessary step since hydrocracking reduces aromatics content to very low levels.

By way of contrast, the process of the present invention utilizes a two step hydroconversion of the raffinate from the solvent extraction unit under conditions which minimizes hydrocracking and hydroisomerization while maintaining residual aromatics content of at least about 5 vol. %. The aromatics content is measured by a high performance liquid chromatography method which quantitates hydrocarbon mixtures into saturate and aromatic content between 1 and 99 wt. %.

The raffinate from the solvent extraction is preferably under-extracted, i.e., the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit is stripped of solvent and then sent to a first hydroconversion unit containing a hydroconversion catalyst. This raffinate feed has a viscosity index of from about 85 to about 105 and a boiling range not to exceed about 600° C., preferably less than 560° C., as determined by ASTM 2887 and a viscosity of from 3 to 10 cSt at 100° C.

Hydroconversion catalysts are those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports.

It is important that the metal oxide support be non-acidic so as to control cracking. A useful scale of acidity for catalysts is based on the isomerization of 2-methyl-2-pentene as described by Kramer and McVicker, J. Catalysis, 92, 355(1985). In this scale of acidity, 2-methyl-2-pentene is subjected to the catalyst to be evaluated at a fixed temperature, typically 200° C. In the presence of catalyst sites, 2-methyl-2-pentene forms a carbenium ion. The isomerization pathway of the carbenium ion is indicative of the acidity of active sites in the catalyst. Thus weakly acidic sites form 4-methyl-2-pentene whereas strongly acidic sites result in a skeletal rearrangement to 3-methyl-2-pentene with very strongly acid sites forming 2,3-dimethyl-2-butene. The mole ratio of 3-methyl-2-pentene to 4-methyl-2-pentene can be correlated to a scale of acidity. This acidity scale ranges from 0.0 to 4.0. Very weakly acidic sites will have values near 0.0 whereas very strongly acidic sites will have values approaching 4.0. The catalysts useful in the present process have acidity values of less than about 0.5, preferably less than about 0.3. The acidity of metal oxide supports can be controlled by adding promoters and/or dopants, or by controlling the nature of the metal oxide support, e.g., by controlling the amount of silica incorporated into a silica-alumina support. Examples of promoters and/or dopants include halogen, especially fluorine, phosphorus, boron, yttria, rare-earth oxides and magnesia. Promoters such as halogens generally increase the acidity of metal oxide supports while mildly basic dopants such as yttria or magnesia tend to decrease the acidity of such supports.

Suitable metal oxide supports include low acidic oxides such as silica, alumina or titania, preferably alumina. Preferred aluminas are porous aluminas such as gamma or eta having average pore sizes from 50 to 200 Å, preferably 75 to 150 Å, a surface area from 100 to 300 $m^2/g$, preferably 150 to 250 $m^2/g$ and a pore volume of from 0.25 to 1.0 $cm^3/g$, preferably 0.35 to 0.8 $cm^3/g$. The supports are preferably not promoted with a halogen such as fluorine as this generally increases the acidity of the support above 0.5.

Preferred metal catalysts include cobalt/molybdenum (1–5% Co as oxide, 10–25% Mo as oxide) nickel/molybdenum (1–5% Ni as oxide, 10–25% Co as oxide) or nickel/tungsten (1–5% Ni as oxide, 10–30% W as oxide) on alumina. Especially preferred are nickel/molybdenum catalysts such as KF-840.

Hydroconversion conditions in the first hydroconversion unit include a temperature of from 340 to 420° C., preferably 360 to 390° C., a hydrogen partial pressure of 600 to 2000 psig (4.2 to 13.8 MPa), preferably 800 to 1500 psig (5.5 to 10.3 MPa), a space velocity of from 0.2 to 3.0 LHSV, preferably 0.3 to 1.0 LHSV and a hydrogen to feed ratio of from 500 to 5000 Scf/B, preferably 2000 to 4000 Scf/B.

The hydroconverted raffinate from the first reactor is then conducted to a second reactor where it is subjected to a cold (mild) hydrofinishing step. The catalyst in this second reactor may be the same as those described above for the first reactor. However, more acidic catalyst supports such as silica-alumina, zirconia and the like may be used in the second reactor.

Conditions in the second reactor include temperatures of from 200 to 320° C., preferably 230 to 300° C., a hydrogen partial pressure of from 600 to 2000 psig (4.2 to 13.8 MPa), preferably 800 to 1500 psig (5.5 to 10.3 MPa), a space velocity of from 1 to 5 LHSV, preferably 1 to 3 LHSV and a hydrogen to feed ratio of from 500 to 5000 Scf/B, preferably 2000 to 4000 Scf/B.

In order to prepare a finished basestock, the hydroconverted raffinate from the second reactor is conducted to a separator e.g., a vacuum stripper (or fractionator) to separate out low boiling products. Such products may include hydrogen sulfide and ammonia formed in the first reactor. If desired, a stripper may be situated between the first and second reactors, but this is not essential to produce basestocks according to the invention.

The hydroconverted raffinate separated from the separator is then conducted to a dewaxing unit. Dewaxing may be accomplished using a solvent to dilute the hydrofinished raffinate and chilling to crystallize and separate wax molecules. Typical solvents include propane and ketones. Preferred ketones include methyl ethyl ketone, methyl isobutyl ketone and mixtures thereof.

The solvent/hydroconverted raffinate mixture may be cooled in a refrigeration system containing a scraped-surface chiller. Wax separated in the chiller is sent to a separating unit such as a rotary filter to separate wax from oil. The dewaxed oil is suitable as a lubricating oil basestock. If desired, the dewaxed oil may be subjected to catalytic isomerization/dewaxing to further lower the pour point. Separated wax may be used as such for wax coatings, candles and the like or may be sent to an isomerization unit.

The lubricating oil basestock produced by the process according to the invention is characterized by the following properties: viscosity index of at least about 105, preferably at least 107, NOACK volatility improvement (as measured by DIN 51581) over raffinate feedstock of at least about 3 wt. %, preferably at least about 5 wt. %, at the same viscosity within the range 3.5 to 6.5 cSt viscosity at 100° C., pour point of −15° C. or lower, and a low toxicity as determined by IP346 or phase 1 of FDA (c). IP346 is a measure of polycyclic aromatic compounds. Many of these compounds are carcinogens or suspected carcinogens, especially those with so-called bay regions [see Accounts Chem. Res. 17, 332(1984) for further details]. The present process reduces these polycyclic aromatic compounds to such levels as to pass carcinogenicity tests even though the total aromatics content of the lubricating oil is at least about 5 vol. %, preferably from 5 to 15 vol. % based on lubricant basestock. The FDA (c) test is set forth in 21 CFR 178.3620 and is based on ultraviolet absorbances in the 300 to 359 nm range.

As can be seen from FIG. 1, NOACK volatility is related to VI for any given basestock. The relationship shown in FIG. 1 is for a light basestock (about 100N). If the goal is to meet a 22 wt. % NOACK volatility for a 100N oil, then the oil should have a VI of about 110 for a product with typical-cut width, e.g., 5 to 50% off by GCD at 60° C. Volatility improvements can be achieved with lower VI product by decreasing the cut width. In the limit set by zero cut width, one can meet 22% NOACK volatility at a VI of about 100. However, this approach, using distillation alone, incurs significant yield debits.

Hydrocracking is also capable of producing high VI, and consequently low NOACK volatility basestocks, but is less selective (lower yields) than the process of the invention. Furthermore both hydrocracking and processes such as wax isomerization destroy most of the molecular species responsible for the solvency properties of solvent refined oils. The latter also uses wax as a feedstock whereas the present process is designed to preserve wax as a product and does little, if any, wax conversion.

Figure 2:
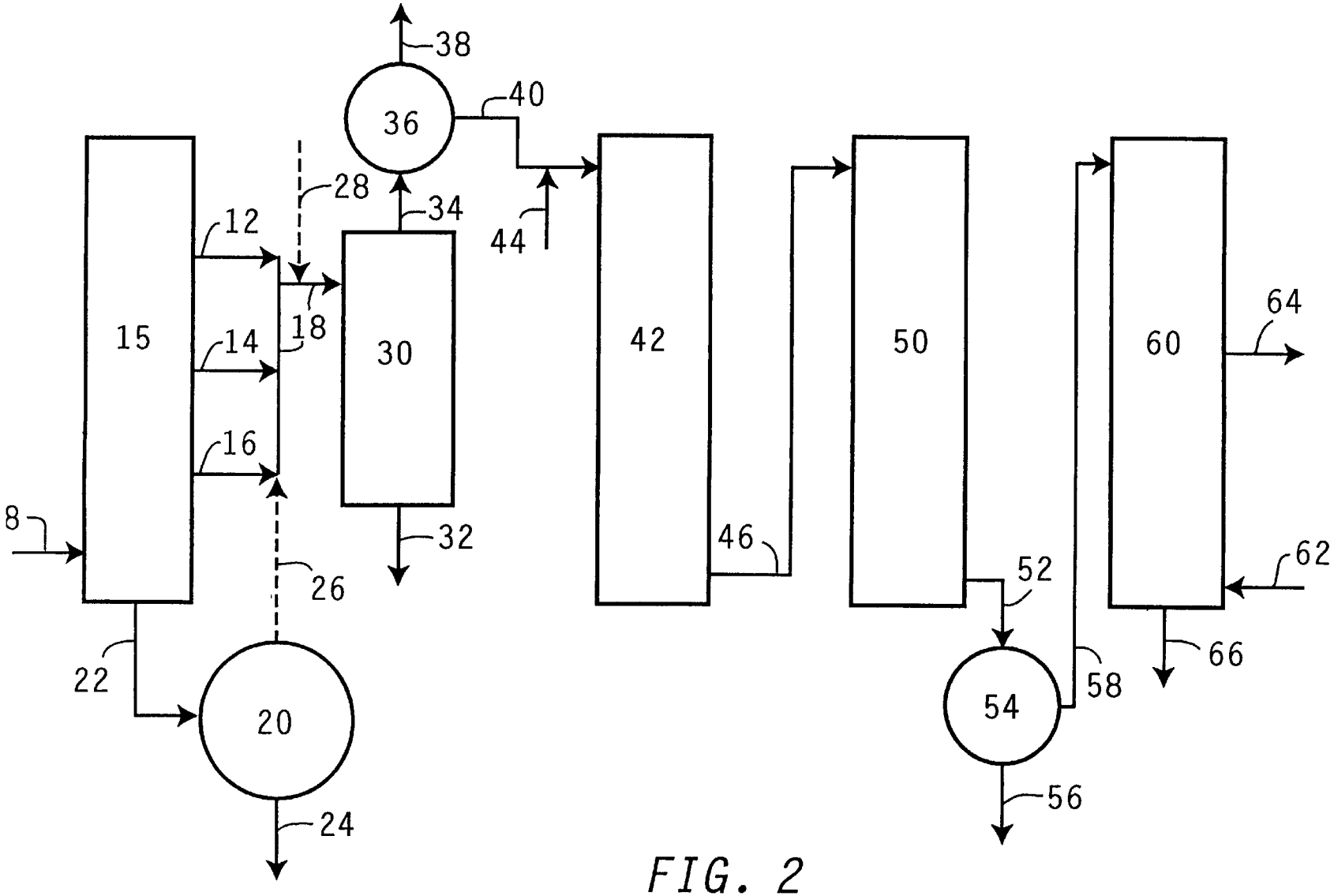
FIG. 2 is a simplified schematic flow diagram of the raffinate hydroconversion process.

The process of the invention is further illustrated by FIG. 2. The feed 8 to vacuum pipestill 15 is typically an atmospheric reduced crude from an atmospheric pipestill (not shown). Various distillate cuts shown as 12 (light), 14 (medium) and 16 (heavy) may be sent to solvent extraction unit 30 via line 18. These distillate cuts may range from about 200° C. to about 600° C. The bottoms from vacuum pipestill 10 may be sent through line 22 to a coker, a visbreaker or a deasphalting extraction unit 20 where the bottoms are contacted with a deasphalting solvent such as propane, butane or pentane. The deasphalted oil may be combined with distillate from the vacuum pipestill 10 through line 26 provided that the deasphalted oil has a boiling point no greater than about 600° C. or is preferably sent on for further processing through line 24. The bottoms from deasphalter 20 can be sent to a visbreaker or used for asphalt production. Other refinery streams such as wax-containing streams may also be added to the feed to the extraction unit through line 28 provided they meet the feedstock criteria described previously for raffinate feedstock. In the alternative, wax-containing streams may be combined with stripped raffinate via line 40 and sent to the first hydroconversion zone.

In extraction unit 30, the distillate cuts are solvent extracted with n-methyl pyrrolidone and the extraction unit is preferably operated in countercurrent mode. The solvent-to-oil ratio, extraction temperature and percent water in the solvent are used to control the degree of extraction, i.e., separation into a paraffins rich raffinate and an aromatics rich extract. The present process permits the extraction unit to operate to an "under extraction" mode, i.e., a greater amount of aromatics in the paraffins rich raffinate phase. The aromatics rich extract phase is sent for further processing through line 32. The raffinate phase is conducted through line 34 to solvent stripping unit 36. Stripped solvent is sent through line 38 for recycling and stripped raffinate is conducted through line 40 to first hydroconversion unit 42.

The first hydroconversion unit 42 contains KF-840 catalyst which is nickel/molybdenum on an alumina support and available from Akzo Nobel. Hydrogen is admitted to unit or reactor 42 through line 44. Unit conditions are typically temperatures of from 340–420° C., hydrogen partial pressures from 600 to 2000 psig, space velocity of from 0.5 to 3.0 LHSV and a hydrogen to feed ratio of from 500 to 5000 Scf/B. Gas chromatographic comparisons of the hydroconverted raffinate indicate that almost no wax isomerization is taking place. While not wishing to be bound to any particular theory since the precise mechanism for the VI increase which occurs in this stage is not known with certainty, it is known that heteroatoms are being removed, aromatic rings are being saturated and naphthene rings, particularly multi-ring naphthenes, are selectively eliminated.

Hydroconverted raffinate from unit 42 is sent through line 46 to second unit or reactor 50. Reaction conditions in unit are mild and include a temperature of from 200–320° C., a hydrogen partial pressure of from 600 to 2000 psig, a space velocity of 1 to 5 LHSV and a hydrogen feed rate of from 500 to 5000 Scf/B. This mild or cold hydrofinishing step further reduces toxicity to very low levels.

Hydroconverted raffinate is then conducted through line 52 to separator 54. Light liquid products and gases are separated and removed through line 56. The remaining hydroconverted raffinate is conducted through line 58 to dewaxing unit 60. Dewaxing may occur by the use of solvents (introduced through line 62) which may be followed by cooling, by catalytic dewaxing or by a combination thereof. Catalytic dewaxing involves hydrocracking and/or hydroisomerization as a means to create low pour point lubricant basestocks. Solvent dewaxing with optional cooling separates waxy molecules from the hydroconverted lubricant basestock thereby lowering the pour point. Hydroconverted raffinate is preferably contacted with methyl isobutyl ketone followed by the DILCHILL Dewaxing Process developed by Exxon. This method is well known in the art. Finished lubricant basestock is removed through line 64 and waxy product through line 66.

In the process according to the invention, any waxy components in the feed to extraction unit 30 passes virtually unchanged through the hydroconversion zone and is conducted to dewaxing unit 60 where it may be recovered as product.

The invention is further illustrated by the following non-limiting examples.

EXAMPLE 1

Thermal diffusion is a technique that can be used for separating hydrocarbon mixtures into molecular types. Although it has been studied and used for over 100 years, no really satisfactory theoretical explanation for the mechanism of thermal diffusion exists. The technique is described in the following literature:

A. L. Jones and E. C. Milberger., Industrial and Engineering Chemistry, p. 2689, December 1953, T. A. Warhall and F. W. Melpolder., Industrial and Engineering Chemistry, p. 26, January 1962, and H. A. Harner and M. M. Bellamy., American Laboratory, p. 41, January 1972 and references therein.

The thermal diffusion apparatus used in the current application was a batch unit constructed of two concentric stainless steel tubes with an annular spacing between the inner and outer tubes of 0.012 in. The length of the tubes was approximate 6 ft. The sample to be tested is placed in the annular space between the inner and outer concentric tubes. The inner tube had an approximate outer diameter of 0.5 in. Application of this method requires that the inner and outer tubes be maintained at different temperatures. Generally temperatures of 100 to 200° C. for the outer wall and about 65° C. for the inner wall are suitable for most lubricating oil samples. The temperatures are maintained for periods of 3 to 14 days.

While not wishing to be bound to any particular theory, the thermal diffusion technique utilizes diffusion and natural convention which arises from the temperature gradient established between the inner and outer walls of the concentric tubes. Higher VI molecules diffuse to the hotter wall and rise. Lower VI molecules diffuse to the cooler inner walls and sink. Thus a concentration gradient of different molecular densities (or shapes) is established over a period of days. In order to sample the concentration gradient, sampling ports are approximately equidistantly spaced between the top and bottom of the concentric tubes. Ten is a convenient number of sampling ports.

Two samples of oil basestocks were analyzed by thermal diffusion techniques. The first is a conventional 150N basestock having a 102 VI and prepared by solvent extraction/ dewaxing methods. The second is a 112 VI basestock prepared by the raffinate hydroconversion (RHC) process according to the invention from a 100 VI, 250N raffinate. The samples were allowed to sit for 7 days after which samples were removed from sampling ports 1–10 spaced from top to bottom of the thermal diffusion apparatus.

Figure 3:
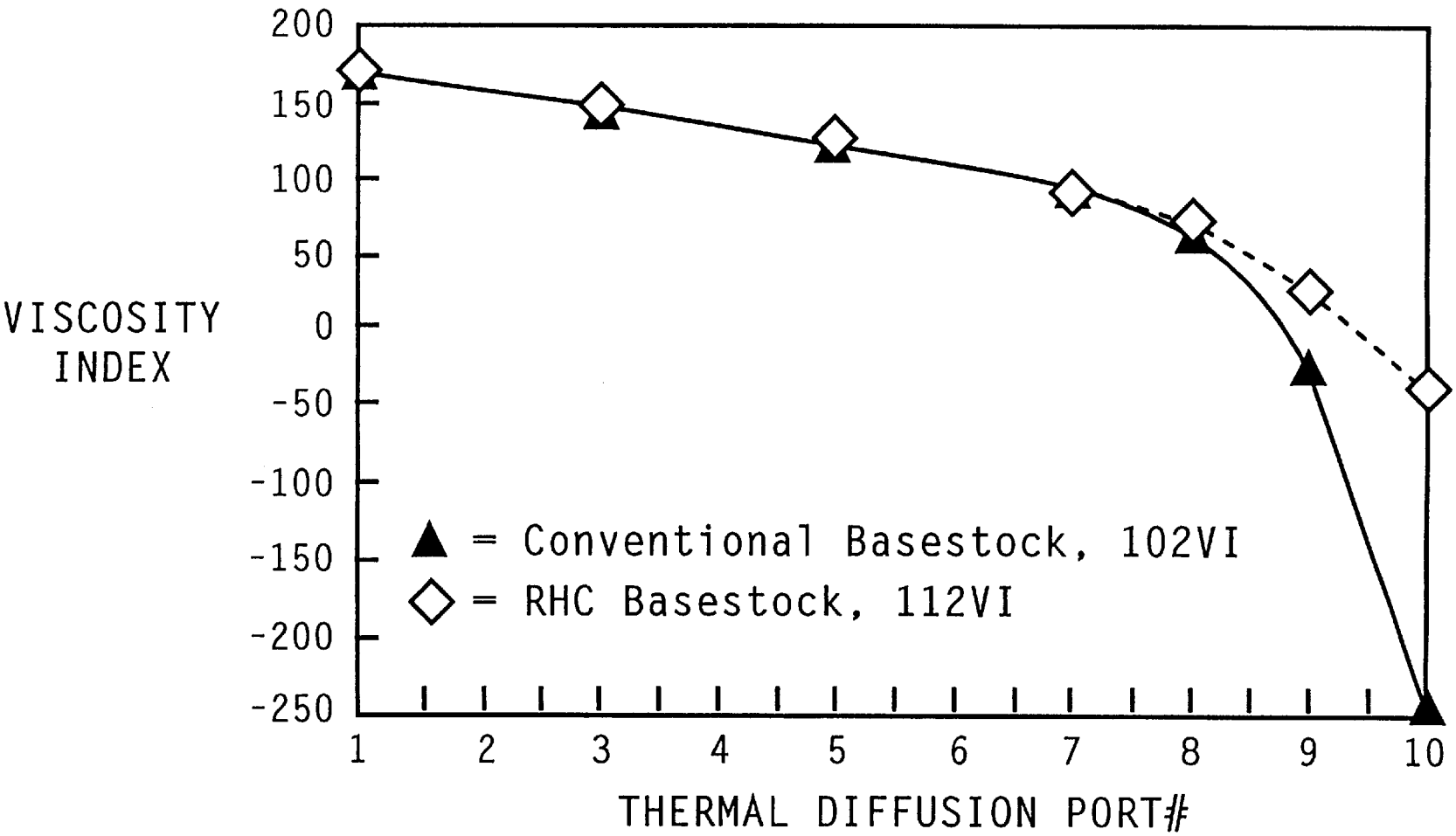
FIG. 3 is a plot of the thermal diffusion separation vs. viscosity index.

The results are shown in FIG. 3. FIG. 3 demonstrates that even a "good" conventional basestock having a 102 VI contains some very undesirable molecules from the standpoint of VI. Thus sampling ports 9 and especially 10 yield molecular fractions containing very low VI's. These fractions which have VI's in the −25 to −250 range likely contain multi-ring naphthenes. In contrast, the RHC product according to the invention contains far fewer multi-ring naphthenes as evidenced by the VI's for products obtained from sampling ports 9 and 10. Thus the present RHC process selectively destroys multi-ring naphthenes and multi-ring aromatics from the feed without affecting the bulk of the other higher quality molecular species. The efficient removal of the undesirable species as typified by port 10 is at least partially responsible for the improvement in NOACK volatility at a given viscosity.

EXAMPLE 2

This Example compares a low acidity catalyst useful in the process according to the invention versus a more acidic catalyst. The low acidity catalyst is KF-840 which is commercially available from Akzo Nobel and has an acidity of 0.05. The other catalyst is a more acidic, commercially available catalyst useful in hydrocracking processes having an estimated acidity of 1 and identified as Catalyst A. The feed is a 250N waxy raffinate having an initial boiling point of 335° C., a mid-boiling point of 463° C. and a final boiling point of 576° C., a dewaxed oil viscosity at 100° C. of 8.13, a dewaxed oil VI of 92 and a pour point of −19° C. The results are shown in Tables 1 and 2.

TABLE 1

Comparison at Similar Conditions

| | Catalyst | |
|---|---|---|
| Operating Conditions | Catalyst A | KF-840 |
| Temperature, °C. | 355 | 360 |
| LHSV, v/v/hr | 0.5 | 0.5 |
| $H_2$ pressure psig | 800 | 800 |
| $H_2$ to feed Scf/B | 1600 | 1300 |
| Conversion to 370° C.-, wt. % | 22 | 11 |
| Product VI | 114 | 116 |

TABLE 2

Comparison at Similar Conversion

| | Catalyst | |
|---|---|---|
| Operating Conditions | Catalyst A | KF-840 |
| Temperature | 345 | 360 |
| LHSV, v/v/hr | 0.5 | 0.5 |
| $H_2$ pressure psig | 800 | 800 |
| $H_2$ to feed Scf/B | 1600 | 1300 |
| Conversion to 370° C.-, wt. % | 11 | 11 |
| Product VI | 107 | 116 |

As can be seen from Table 1, if reaction conditions are similar, then Catalyst A gives a much higher conversion. If conversion is held constant (by adjusting reaction conditions), then the VI of the product from Catalyst A is much lower. These results show that while more acidic catalysts have higher activity, they have much lower selectivity for VI improvement.

EXAMPLE 3

This example shows that processes like lubes hydrocracking which typically involve a more acid catalyst in the second of two reactors is not the most effective way to improve volatility properties. The results for a 250N raffinate feed having a 100 VI DWO is shown in Table 3. Product was topped to the viscosity required and then dewaxed.

TABLE 3

| 2 Reactor 2 Catalyst* Two Stage Process | | | Raffinate Hydroconversion** | | |
|---|---|---|---|---|---|
| Yield | Viscosity,cSt @ 100° C. | NOACK*** Volatility, wt. % | Yield | Viscosity,cSt @ 100° C. | NOACK Volatility |
| 30.5 | 6.500 | 3.3 | 69.7 | 6.500 | 3.6 |

*1st stage conditions: Ni/Mo catalyst, 360° C., 800 psig $H_2$, 0.5 LHSV, 1200 Scf/B
2nd stage conditions: Ni/Mo/Silica alumina catalyst, 366° C., 2000 psig $H_2$, 1.0 LHSV, 2500 Scf/B
**Conditions: KF-840 catalyst, 353° C., 800 psig $H_2$, 0.49 LHSV, 1200 Scf/B
***Estimated by GCD With an acid silica-alumina type catalyst in the second reactor of the 2 reactor process, the yield of product of a given volatility at the same viscosity is lower than the yield of the process of the invention using raffinate feeds. This confirms that a low acidity catalyst is required to achieve low volatility selectively.

EXAMPLE 4

Many current commercially available basestocks will have difficulty meeting future engine oil volatility requirements. This examples demonstrates that conventional extraction techniques vs. hydroconversion techniques suffer from large yield debits in order to decrease NOACK volatility. NOACK volatility was estimated using gas chromatographic distillation (GCD) set forth in ASTM 2887. GCD NOACK values can be correlated with absolute NOACK values measured by other methods such as DIN 51581.

The volatility behavior of conventional basestocks is illustrated using an over-extracted waxy raffinate 100N sample having a GCD NOACK volatility of 27.8 (at 3.816 cSt viscosity at 100° C.). The NOACK volatility can be improved by removing the low boiling front end (Topping) but this increases the viscosity of the material. Another alternative to improving NOACK volatility is by removing material at both the high boiling and low boiling ends of the feed to maintain a constant viscosity (Heart-cut). Both of these options have limits to the NOACK volatility which can be achieved at a given viscosity and they also have significant yield debits associated with them as outlined in the following table;

TABLE 4

Distillation Assay of 100N Over-Extracted Waxy Raffinate (103 VI DWO*)

| Processing | NOACK Volatility, wt. %** | Yield, % | Viscosity, cSt @ 100° C. |
|---|---|---|---|
| None | 27.8 | 100 | 3.816 |
| Topping | 26.2 | 95.2 | 3.900 |
| Heart-cut | 22.7 | 58.0 | 3.900 |
| Heart-cut | 22.4 | 50.8 | 3.900 |
| Heart-cut | 21.7 | 38.0 | 3.900 |

*DWO = dewaxed oil
**estimated by GCD

EXAMPLE 5

The over-extracted feed from Example 4 was subjected to raffinate hydroconversion under the following conditions: KF-840 catalyst at 353° C., 800 psig $H_2$, 0.5 LHSV, 1200 Scf/B. Raffinate hydroconversion under these conditions increased the DWO VI to 111. The results are given in Table 5.

TABLE 5

Distillation Assay of Hydroconverted Waxy Raffinate (103VI to 111 VI DWO)

| Processing | NOACK* Volatility | Yield, % | Viscosity, cSt @ 100° C. |
|---|---|---|---|
| None | 38.5 | 99.9 | — |
| Topping | 21.1 | 76.2 | 3.900 |
| Heart-cut | 20.9 | 73.8 | 3.900 |
| Heart-cut | 19.9 | 62.8 | 3.900 |
| Heart-cut | 19.2 | 52.2 | 3.900 |
| Heart-cut | 18.7 | 39.6 | 3.900 |

*Estimated by GCD

These results demonstrate that raffinate hydroconversion can achieve lower NOACK volatility much more selectivity than by distillation alone, e.g., more than double the yield at 21 NOACK. Furthermore, since the process of the invention removes poorer molecules, much lower volatilities can be achieved than by distillation alone.

EXAMPLE 6

This example illustrates the preferred feeds for the raffinate hydroconversion (RHC) process. The results given in Table 6 demonstrate that there is an overall yield credit associated with lower VI raffinates to achieve the same product quality (110 VI) after topping and dewaxing. The table illustrates the yields achieved across RHC using 100N raffinate feed.

TABLE 6

| Feed VI | NOACK Volatility | Viscosity cSt @ 100° C. | Extraction Yield | Hydro-processing Yield | Yield of Waxy Product (on distillate) |
|---|---|---|---|---|---|
| 103* | 21.1 | 3.900 | 53.7 | 76.2 | 40.9 |
| 92** | 21.1 | 4.034 | 73.9 | 63.8 | 47.1 |

*KF-840 catalyst, 353° C., 800 psig $H_2$, 0.5 LHSV, 1200 Scf/B
**KF-840 catalyst,, 363–366° C., 1200 psig $H_2$, 0.7 LHSV, 2400 Scf/B The yield to get to a 110 VI product directly from distillate by extraction alone is only 39.1% which further illustrates the need to combine extraction with hydroprocessing.

While under-extracted feeds produce higher yields in RHC, use of distillates as feeds is not preferred since very severe conditions (high temperature and low LHSV) are required. For example, for a 250N distillate over KF-840 at 385° C., 0.26 LHSV, 1200 psi $H_2$, and 2000 Scf/B gas rate, only 104 VI product was produced.

Also, combinations of distillate hydroprocessing (to reach an intermediate VI) then extraction to achieve target VI is not preferred. This is because the extraction process is nonselective for removal of naphthenes created from aromatics in the distillate hydroprocessing stage.

EXAMPLE 7

In the raffinate hydroconversion process according to the invention, the first reaction zone is followed by a second cold hydrofining (CHF) zone. The purpose of CHF is to reduce the concentration of molecular species which contribute to toxicity. Such species may include 4- and 5-ring polynuclear aromatic compounds, e.g., pyrenes which either pass through or are created in the first reaction zone. One of the tests used as an indicator of potential toxicity is the FDA "C" test (21 CFR 178.3620) which is based on absorbances in the ultraviolet (UV) range of the spectrum. The following table demonstrates that CHF produces a product with excellent toxicological properties which are much lower than the acceptable maximum values.

TABLE 7

| | FDA "C" | | | |
|---|---|---|---|---|
| | 280–289 nm | 290–299 nm | 300–359 nm | 360–400 nm |
| FDA "C" MAX (Absorbance Units) | 0.7 | 0.6 | 0.4 | 0.09 |
| Sample | | | | |
| CHF Products | | | | |
| DLM-120 | 0.42 | 0.25 | 0.22 | 0.024 |
| (CHF Process Conditions: 3 v/v/h, 260° C., 800 psig, 1200 Scf/B Hydrogen (containing N = 38 wppm, S = 0.6 wt. % on feed)) | | | | |
| DLM-118 | 0.26 | 0.14 | 0.11 | 0.013 |
| (CHF Process Conditions: 3 v/v/h, 260° C., 800 psig, 1200 Scf/B Hydrogen) | | | | |
| CHF Products | | | | |
| DLM-115 | 0.36 | 0.23 | 0.17 | 0.016 |
| (CHF Process Conditions: 2 v/v/h, 260° C., 800 psig, 1200 Scf/B) | | | | |

These results demonstrate that a CHF step enables the product to easily pass the FDA "C" test.

EXAMPLE 8

Example 8 shows that products from RHC have outstanding toxicological properties versus basestocks made either by conventional solvent processing or hydrocracking. Besides FDA "C", IP 346 and modified Ames (mutagenicity index) are industry wide measures of toxicity. The results are shown in Table 8.

TABLE 8

| | Commercial Solvent Extracted Basestock | | Commercial Hydrocracked Basestock | RHC Basestock | |
|---|---|---|---|---|---|
| | 100N | 250N | 100N | 100N | 250N |
| IP346, wt. % | 0.55 | 0.55 | 0.67 | 0.11 | 0.15 |
| Mod Ames, MI | 0.0 | 0.0 | 0.0 | 0.0 | 0.0 |
| FDA(C) (phase I) (300–359 nm) | 0.22 | 0.22 | 0.21 | 0.02 | 0.03 |

The results in Table 8 demonstrate that RHC produces a basestock with much improved toxicological properties over conventional solvent extracted or hydrocracked basestocks

EXAMPLE 9

This example demonstrates that feeds in addition to raffinates can be upgraded to higher quality basestocks. The upgrading of low value foots oil streams is shown in this example. Foots oil is a waxy by-product stream removed from slack wax to produce a finished wax and contains about 60 wt % wax. This material can be used either directly or as a feed blend stock with under extracted raffinates or dewaxed oils. In the example below (Table 9), foots oil feeds were upgraded at 650 psig (4.58 mPa) $H_2$ to demonstrate their value in the context of this invention. Reactor C was not included in the processing. Two grades of foots oil, a 500N and 150N, were used as feeds.

TABLE 9

| | 500 N | | 150 N | |
|---|---|---|---|---|
| | Feed | Product | Feed | Product |
| Temperature, °C. (Reactor A/B) | — | 354 | — | 354 |
| Treat Gas rate, Scf/B, ($m^3/m^3$) | — | 500 (89) | — | 500 (89) |
| Hydrogen partial pressure, psig (mPa) | — | 650 (4.58) | — | 650 (4.58) |
| LHSV, v/v/hr (Reactor A + B) | — | 1.0 | — | 1.0 |
| wt. % 370° C. - on feed | 0.22 | 3.12 | 1.10 | 2.00 |
| 370° C. + DWO Inspections | | | | |
| 40° C. viscosity, cSt | 71.01 | 48.80 | 25.01 | 17.57 |
| 100° C. viscosity, cSt | 8.85 | 7.27 | 4.77 | 4.01 |
| VI/Pour Point, °C. | 97/−15 | 109/−17(2) | 111/−8 | 129/−9(2) |
| Saturates, wt. % | 73.4 | 82.8(1) | 79.03 | 88.57(1) |
| GCD NOACK, wt. % | 4.2 | 8.0 | 19.8 | 23.3 |
| Dry Wax, wt. % | 66.7 | 67.9 | 83.6 | 83.3 |
| DWO Yield, wt. % of Foots Oil Feed | 33.2 | 31.1 | 16.2 | 15.9 |

(1)Saturates improvement will be higher at higher hydrogen pressures
(2)Excellent blend stock Table 9 shows that both a desirable basestock with significantly higher VI and saturates content and a valuable wax product can be recovered from foots oil. In general, since wax molecules are neither consumed or formed in this process, inclusion of foots oil streams as feed blends provides a means to recover the valuable wax while improving the quality of the resultant base oil product.

What is claimed is:

1. A process for upgrading a wax-containing feedstock to produce a lubricating oil basestock suitable for use as an automobile engine oil and a petroleum wax by selectively hydroconverting a raffinate produced from solvent refining a lubricating oil feedstock which comprises:

(a) conducting the lubricating oil feedstock and the wax-containing feedstock, said feedstock being a distillate fraction, to a solvent extraction zone and under-extracting the feedstock to form an under-extracted raffinate whereby the yield of raffinate is maximized;

(b) stripping the under-extracted raffinate of solvent to produce an under-extracted raffinate feed having a dewaxed oil viscosity index from about 85 to about 105 and a final boiling point of no greater than about 650° C.;

(c) passing the raffinate feed to a first hydroconversion zone and processing the raffinate feed in the presence of a non-acidic catalyst having an acidity value less than about 0.5, said acidity being determined by the ability of the catalyst to convert 2-methylpent-2-ene to 3-methylepent-2-ene and 4-methylpent-2-ene and is expressed as the mole ratio of 3-methylpent-2-ene to 4-methylpent-2-ene at a temperature of from 340 to 420° C., a hydrogen partial pressure of from 600 to 2000 psig, space velocity of 0.2 to 3.0 LHSV and a hydrogen to feed ratio of from 500 to 5000 Scf/B to produce a first hydroconverted raffinate;

(d) passing the first hydroconverted raffinate to a second reaction zone and conducting cold hydrofinishing of the first hydroconverted raffinate in the presence of a hydrofinishing catalyst which is at least one Group VIB and Group VIII metal oxide or metal sulfide on a refractory metal oxide support at a temperature of from 200 to 320° C., a hydrogen partial pressure of from 600 to 2000 psig, a space velocity of from 1 to 5 LHSV and hydrogen to feed ratio of from 500 to 5000 Scf/B to produce a second hydroconverted raffinate;

(e) passing the second hydroconverted raffinate to a separation zone to remove products having a boiling less than about 250° C.; and (f) passing the second hydroconverted raffinate to a dewaxing zone to produce a wax and a dewaxed basestock having a viscosity index of at least 105 provided that the basestock has a dewaxed oil viscosity index increase of at least 10 greater than the dewaxed oil viscosity index of the raffinate feed, a NOACK volatility improvement over raffinate feedstock of at least about 3 wt. % at the same viscosity in the range of viscosity from 3.5 to 6.5 cSt viscosity at 100° C., and a residual aromatics content of at least about 5 vol. % provided that the basestock has low toxicity and passes the IP346 or FDA(c) tests notwithstanding the residual aromatics content, and (g) isolating the wax from step (f) as a co-product.

2. The process of claim 1 wherein the raffinate feed has a final boiling point no greater than about 560° C.

3. The process of claim 1 wherein the temperature in the first hydroconversion zone is from 360 to 390° C.

4. The process of claim 1 wherein the non-acidic catalyst is cobalt/molybdenum, nickel/molybdenum or nickel/tungsten on an alumina support.

5. The process of claim 1 wherein the cold hydrofinishing is conducted at a temperature of from 230 to 300° C.

6. The process of claim 1, wherein the separation zone comprises a vacuum stripper.

7. The process of claim 1 wherein the dewaxed basestock has a VI of at least 107.

8. The process of claim 1 wherein the dewaxed basestock has a NOACK volatility improvement over raffinate feedstock of at least about 5 wt. %, in the range of 3.5 to 6.5 cSt viscosity at 100° C.

9. The process of claim 1 wherein the second hydroconverted raffinate is dewaxed by solvent dilution followed by cooling to crystallize wax molecules.

10. The process of claim 4 wherein the catalyst is nickel/molybdenum on an alumina support provided that the alumina support has not been promoted with a halogen.

11. The process of claim 1 wherein the non-acidic catalyst has an acidity value less than about 0.5.

12. A process for upgrading a wax-containing feedstock to produce a lubricating oil basestock suitable for use as an automobile engine oil and a petroleum wax by selectively hydroconverting a raffinate produced from solvent refining a lubricating oil feedstock which comprises:

(a) conducting the lubricating oil feedstock, said feedstock being a distillate fraction, to a solvent extraction zone and under-extracting the feedstock to form an under-extracted raffinate whereby the yield of raffinate is maximized;

(b) stripping the under-extracted raffinate of solvent to produce an under-extracted raffinate feed having a dewaxed oil viscosity index from about 85 to about 105 and a final boiling point of no greater than about 650° C.;

(c) combining the raffinate feed with the wax-containing feedstock to produce a combined raffinate feed, (d) passing the combined raffinate feed to a first hydroconversion zone and processing the combined raffinate feed in the presence of a non-acidic catalyst having an acidity value less than about 0.5, said acidity being determined by the ability of the catalyst to convert 2-methylpent-2-ene to 3-methylpent-2-ene and 4-methylpent-2-ene and is expressed as the mole ratio of 3-methylpent-2-ene to 4-methylpent-2-ene at a temperature of from 340 to 420° C., a hydrogen partial pressure of from 800 to 2000 psig, space velocity of 0.2 to 3.0 LHSV and a hydrogen to feed ratio of from 500 to 5000 Scf/B to produce a first hydroconverted raffinate; and (e) passing the first hydroconverted raffinate to a second reaction zone and conducting cold hydrofinishing of the first hydroconverted raffinate in the presence of a hydrofinishing catalyst which is at least one Group VIB and Group VIII metal oxide or metal sulfide on a refractory metal oxide support at a temperature of from 200 to 320° C., a hydrogen partial pressure of from 600 to 2000 psig, a space velocity of from 1 to 5 LHSV and hydrogen to feed ratio of from 500 to 5000 Scf/B to produce a second hydroconverted raffinate, (f) passing the second hydroconverted raffinate to a separation zone to remove products having a boiling less than about 250° C.; and (g) passing the second hydroconverted raffinate to a dewaxing zone to produce a wax and a dewaxed basestock having a viscosity index of at least 105 provided that the basestock has a dewaxed oil viscosity index increase of at least 10 greater than the dewaxed oil viscosity index of the raffinate feed, a NOACK volatility improvement over raffinate feedstock of at least about 3 wt. % at the same viscosity in the range of viscosity from 3.5 to 6.5 cSt viscosity at 100° C., and a residual aromatics content of at least about 5 vol. % provided that the basestock has low toxicity and passes the IP346 or FDA(c) tests notwithstanding the residual aromatics content, and (h) isolating the wax from step (g) as a co-product.

13. The process of claim 12 wherein the raffinate feed has a final boiling point no greater than about 500° C.

14. The process of claim 12 wherein the temperature in the first hydroconversion zone is from 360 to 390° C.

15. The process of claim 12 wherein the non-acidic catalyst is cobalt/molybdenum, nickel/molybdenum or nickel/tungsten on an alumina support.

16. The process of claim 12 wherein the cold hydrofinishing is conducted at a temperature of from 230 to 300° C.

17. The process of claim 12 wherein the second hydroconverted raffinate has residual aromatics content of at least about 5 vol. % provided that the raffinate has low toxicity and passes the IP346 or FDA(c) tests notwithstanding the residual aromatics content.

18. The process of claim 12 wherein the non-acidic catalyst has an acidity value less than about 0.5.

19. The process of claim 12 wherein the second hydroconverted raffinate is dewaxed by solvent dilution followed by cooling to crystallize wax molecules.

* * * * *